US005975004A

United States Patent [19]

Nesseth

[11] Patent Number: 5,975,004

[45] Date of Patent: Nov. 2, 1999

[54] SEAT AND ROWING ATTACHMENT FOR A CANOE

[76] Inventor: Michael J. Nesseth, 21215 Iverson Ave. N., Forest Lake, Minn. 55025

[21] Appl. No.: 09/085,658

[22] Filed: May 28, 1998

Related U.S. Application Data

[60] Provisional application No. 60/047,953, May 29, 1997.

[51] Int. Cl.[6] ..... B63B 35/00

[52] U.S. Cl. ..... 114/347; 114/363; 440/104; 440/102

[58] Field of Search ..... 114/363; 440/101, 440/104, 102, 103

[56] References Cited

U.S. PATENT DOCUMENTS

| | | | |
|---|---|---|---|
| 66,847 | 7/1867 | Jacobs . | |
| 2,466,351 | 4/1949 | Ankarlo | 9/25 |
| 2,536,451 | 1/1951 | Lanning et al. | 9/25 |
| 2,613,373 | 10/1952 | Magdits | 9/25 |
| 2,815,517 | 12/1957 | Andresen, Jr. | 9/7 |
| 4,045,834 | 9/1977 | Mason | 114/363 |
| 4,068,611 | 1/1978 | Leather | 115/24.1 |
| 4,380,208 | 4/1983 | Goserud | 114/347 |
| 4,623,314 | 11/1986 | Waugh | 440/104 |
| 4,649,852 | 3/1987 | Piantedosi | 114/363 |
| 4,662,304 | 5/1987 | Lorech | 114/363 |
| 5,100,352 | 3/1992 | Dunstan | 440/102 |

*Primary Examiner*—Stephen Avila
*Attorney, Agent, or Firm*—Mau & Krull, P.A.

[57] ABSTRACT

A canoe attachment includes a frame made of cylindrical members arranged in a substantially rectangular configuration. A seat is suspend between the forward frame member and the rearward frame member. A "forward-facing" rowing assembly is rotatably mounted on each of the opposite side frame members.

19 Claims, 5 Drawing Sheets

FIG.4A
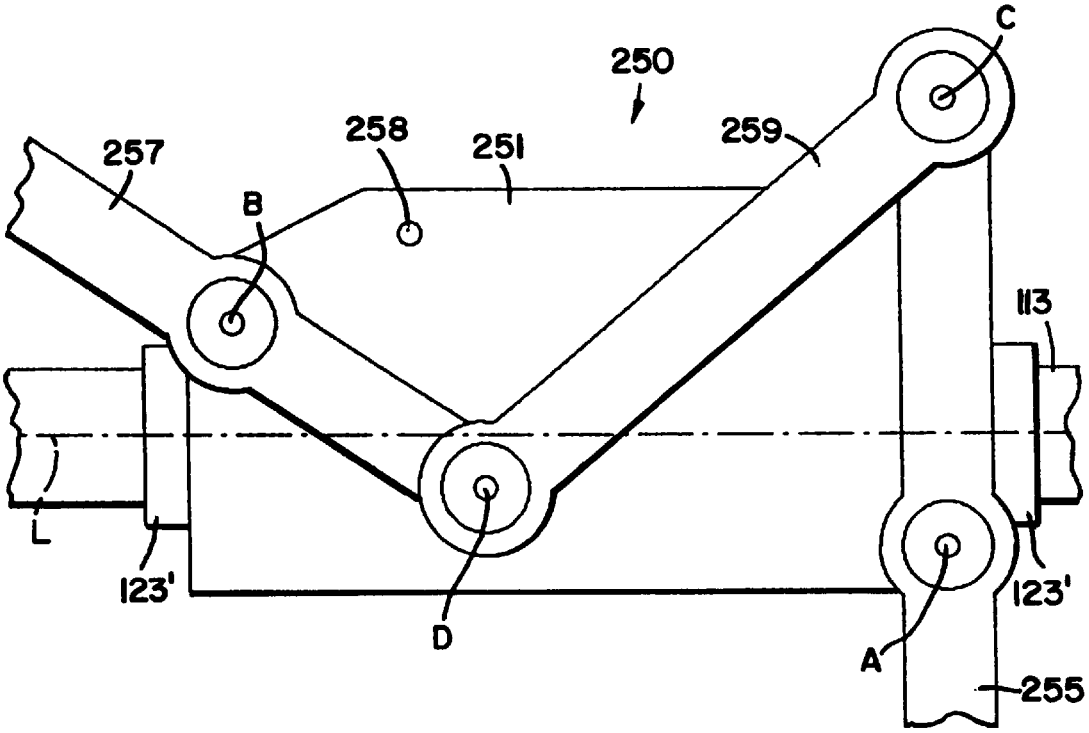
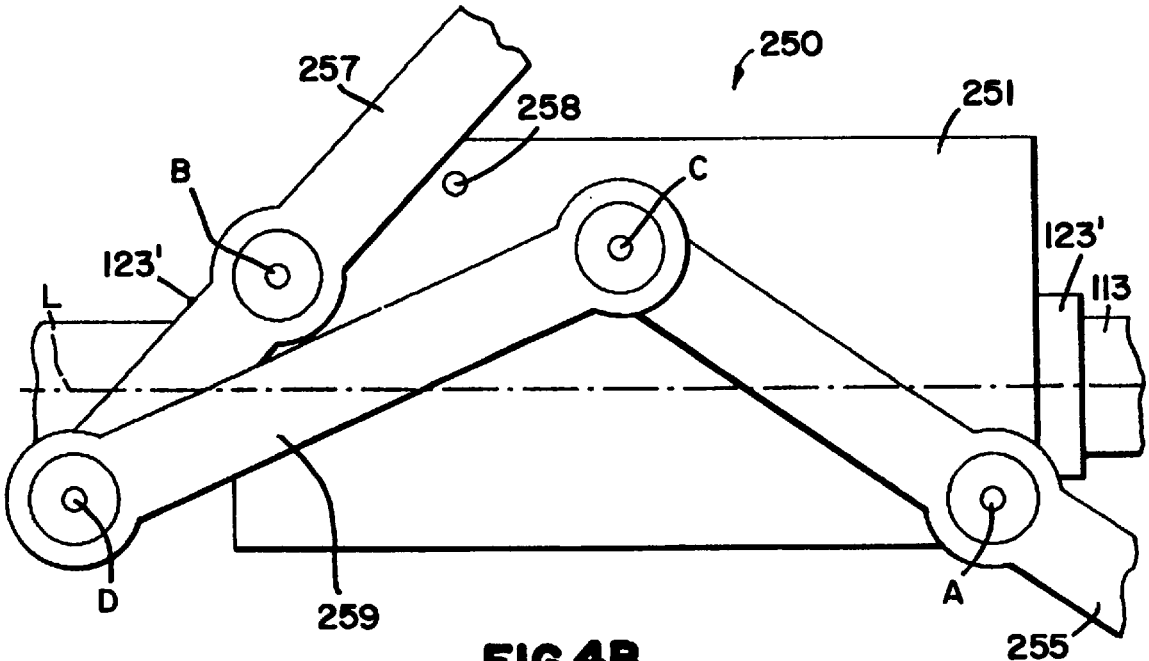
FIG.4B

SEAT AND ROWING ATTACHMENT FOR A CANOE

CROSS REFERENCE TO RELATED APPLICATION

This application discloses subject matter which is entitled to the earlier filing date of provisional application Ser. No. 60/047,953 filed on May 29, 1997.

FIELD OF THE INVENTION

The present invention relates to watercraft and in particular, to a canoe attachment which provides a seat and a forward-facing oar assembly.

BACKGROUND OF THE INVENTION

Both U.S. Pat. No. 2,815,517 to Andersen, Jr. and U.S. Pat. No. 4,649,852 to Piantedosi disclose a canoe attachment having a seat and oar supporting brackets. U.S. Pat. No. 4,068,611 to Leather discloses a sailing vessel attachment having a seat and oar supporting brackets. However, by converting any of these watercraft in the manners disclosed, one sacrifices the ability to see where one is going.

"Forward-facing" rowing assemblies are disclosed in several patents, including U.S. Pat. No. 2,536,451 to Lanning et al., U.S. Pat. No. 2,613,373 to Magdits, and U.S. Pat. No. 5,100,352 to Dunstan. Though enabling rowers to see where they are going, these devices are designed primarily for mounting on rowboats and do not appear to be readily adaptable for convenient installation and use on a canoe. In other words, there exists a need for a "forward-facing" rowing assembly which is designed specifically for attachment and operation relative to a conventional canoe.

SUMMARY OF THE INVENTION

One aspect of the present invention is to provide a "forward-facing" rowing attachment for a conventional canoe. Another aspect of the present invention is to provide a canoe attachment having a suspended seat and/or foot supports. Yet another aspect of the present invention is to provide a canoe attachment having a frame adapted for mounting on a canoe; a seat suspended from the frame; and "forward-facing" rowing attachments mounted on the frame. Additional aspects and advantages of the present invention will become apparent to those skilled in the art from the more detailed description that follows.

BRIEF DESCRIPTION OF THE FIGURES OF THE DRAWING

With reference to the Figures of the Drawing, wherein like numerals represent like parts throughout the several views.

FIGS. 4*a* and 4*b* are top plan views of an alternative rowing assembly portion suitable for use on the embodiment of FIG. 1.

DETAILED DESCRIPTION OF A PREFERRED EMBODIMENT

Figure 1:
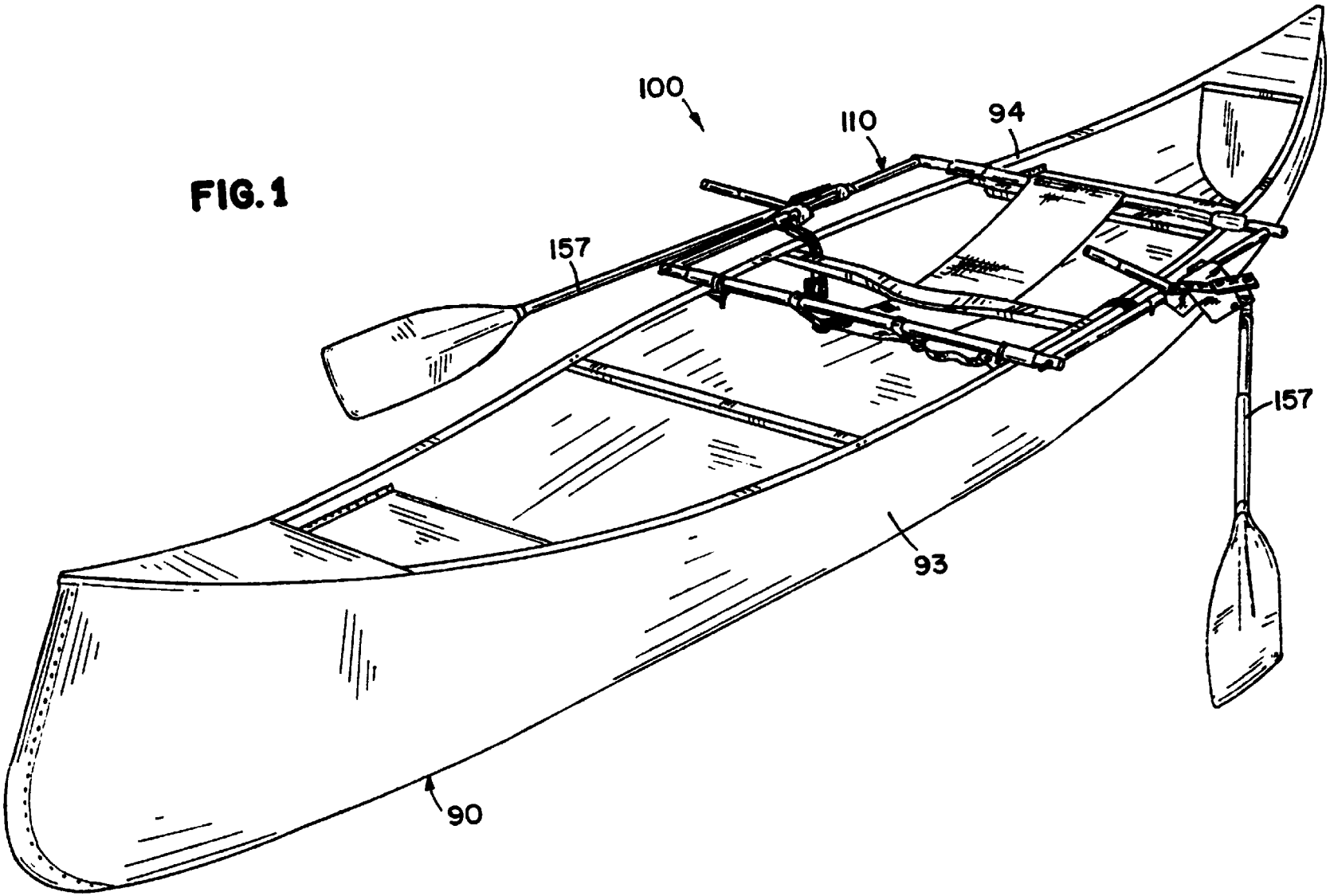
FIG. 1 is a perspective view of a first embodiment of the present invention shown in relation to a conventional canoe.
Figure 2:
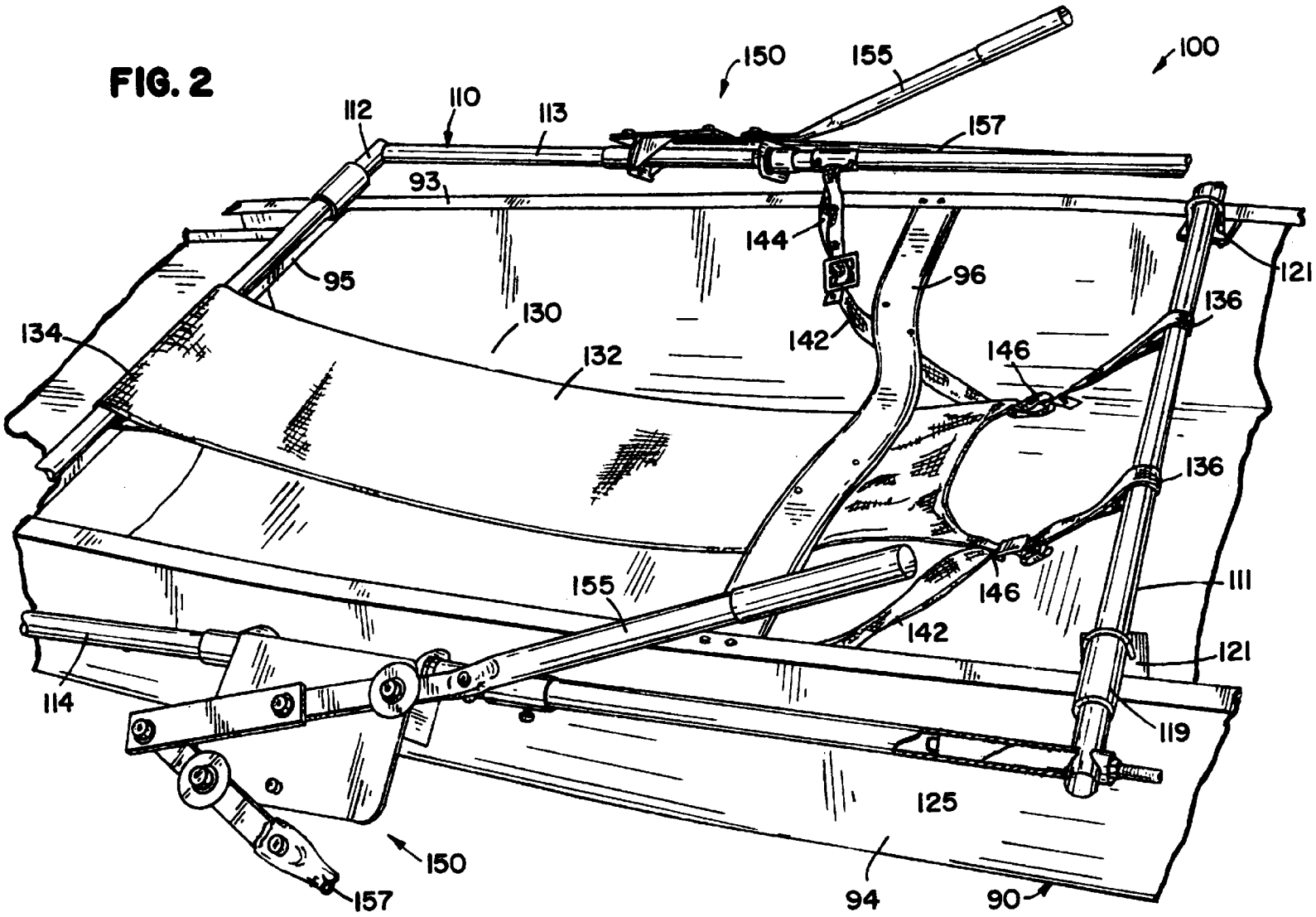
FIG. 2 is a perspective view of portions of the embodiment and canoe of FIG. 1.
Figure 3:
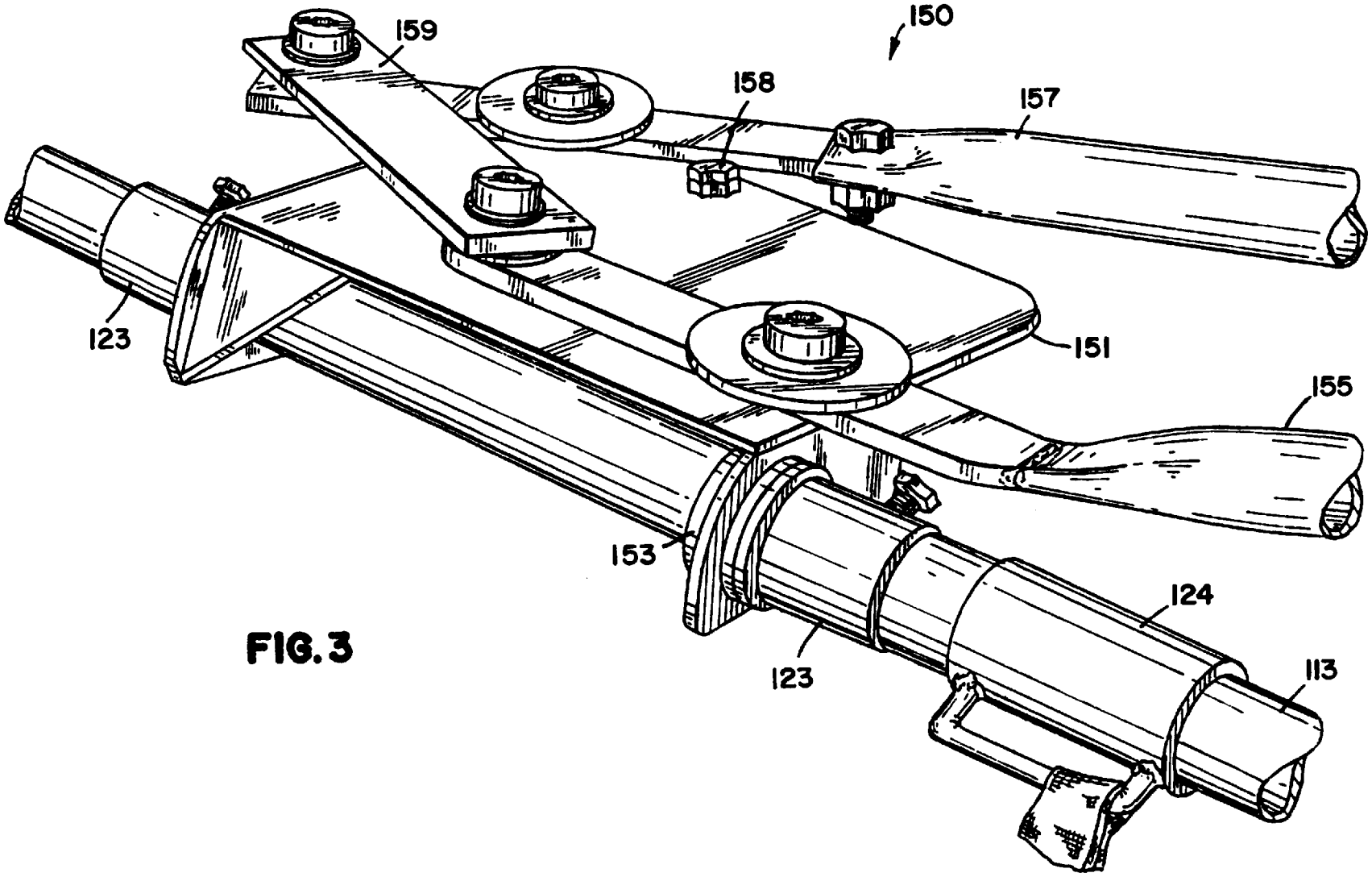
FIG. 3 is a perspective view of a rowing assembly portion of the embodiment of FIG. 1.

A first embodiment of the present invention is designated as 100 and shown in relation to a conventional canoe 90 in FIGS. 1–2. The apparatus 100 generally includes a frame 110; a first means 130, suspended from the frame 110, for supporting a person in a seated position facing in a forward direction; and a second means 150, mounted on the frame 110, for enabling the person to row the canoe 90 in a forward-facing direction.

The frame 110 comprises four steel tubes having an outside diameter of one inch. The tubes or frame members 111–114 are interconnected in a manner known in the art to form a generally rectangular configuration. In particular, rearward ends of the port and starboard frame members 113 and 114 are welded to opposite ends of the rearward frame member 112. Forward ends of the port and starboard frame members 113 and 114 are secured to opposite ends of the forward frame member 112 by means of a bolt assembly 125, which includes a threaded nut welded to a first cylindrical member, a second cylindrical member adjacent the first cylindrical member, a washer, another threaded nut, and a threaded shaft extending through all of the aforementioned components. The two cylindrical members have abutting ends which are angled in complementary fashion. Rotation of the outer nut in a first direction tightens the bolt assembly and compresses the forward frame member 111 between the washer and the nearer cylindrical member, and rotation of the outer nut in an opposite direction loosens the bolt assembly.

The width of the frame 110, as defined by the length of the forward frame member 111 and/or the length of the rearward frame member 112, is greater than the width of the canoe 90. As a result, the port frame member 113 and the starboard frame member 114 are disposed outside the planform or sidewalls 93 and 94 of the canoe 90, and the forward frame member 111 and the rearward frame member 112 extend across and rest upon the canoe sidewalls 93 and 94. As a result, the frame 110 may be positioned at various locations along to the canoe 90 to avoid interference with supports and/or braces 95 and 96 which extend laterally between the sidewalls 93 and 94 of the canoe 90.

Rubber pads or mounts 119 are provided on the forward frame member 111 and the rearward frame member 112 to bear against the upper edges of the sidewalls 93 and 94. The pads 119 reduce the likelihood of damage to the canoe 90 and also discourage the frame 110 from slipping relative to the canoe 90. Clamps 121 are provided to secure the forward frame member 111 to the sidewalls 93 and 94 of the canoe 90.

Figure 5:
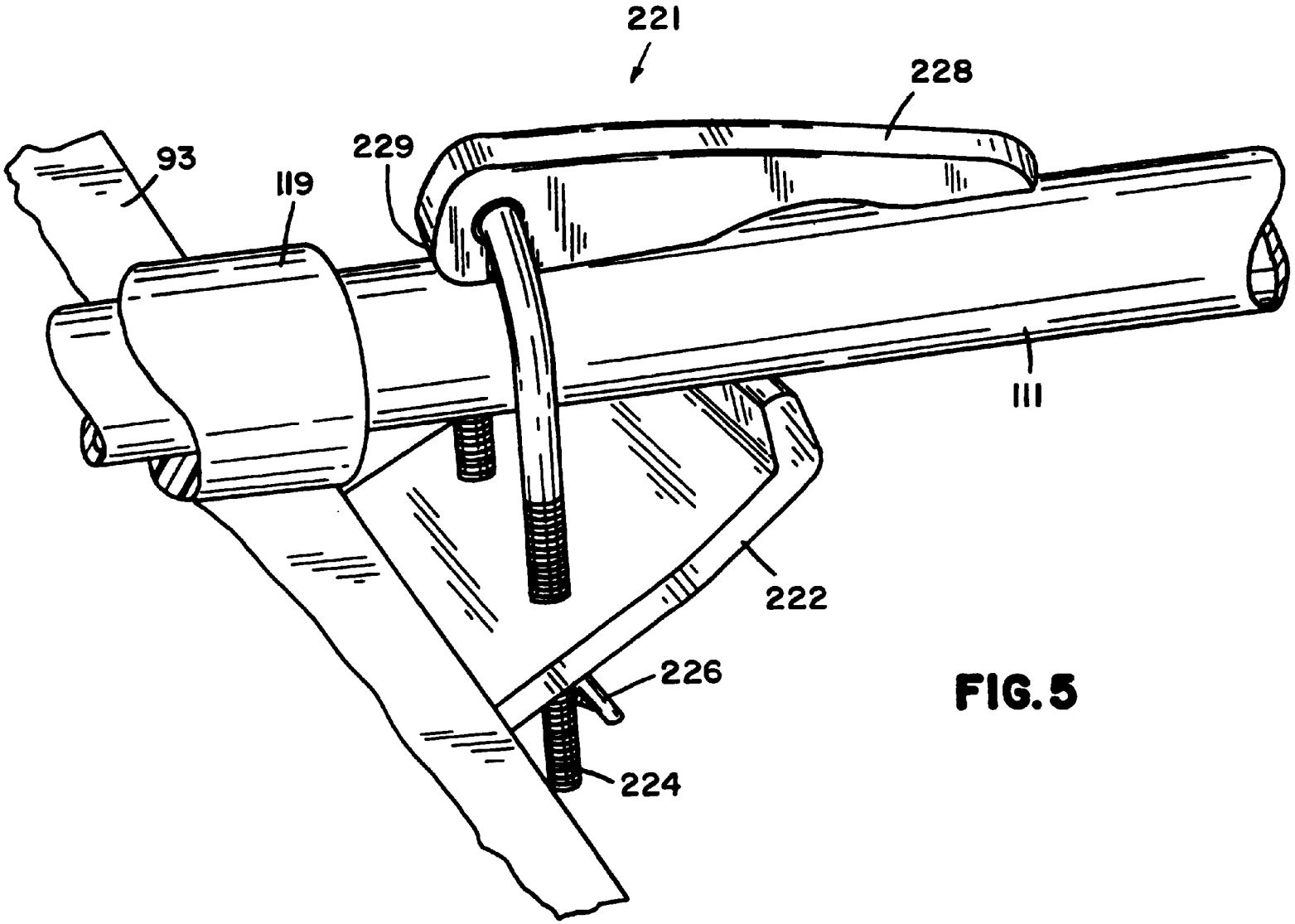
FIG. 5 is a perspective view of a quick-release connector suitable for use on the embodiment and canoe of FIG. 1.

An alternative clamp arrangement is designated as 221 in FIG. 5. The assembly 221 includes a base member 222 having a generally U-shaped profile. A first distal leg of the base member 222 is disposed beneath an upper lip on the canoe sidewall 93, and an opposite, second distal leg of the base member 222 bears against the lower side of the frame member 111. A lever 228, having an "over-center" cam surface 229, is maneuvered onto a central, curved portion of a U-shaped bolt 224 before the bolt 224 is connected to the base member 222. The curved portion of the bolt 224 is then disposed about the upper side of the frame member 111, and parallel linear portions of the bolt 224 are inserted through respective holes in the member 222. Wing nuts 226 are threaded onto respective linear portions of the bolt 224 to retain the member 222 on the bolt 224 and also, to provide a means for adjusting the magnitude of the camming effect provided by the lever 228. When the lever 228 is moved to the position shown in FIG. 5, the frame member 111 is effectively clamped to the canoe sidewall 93. The lever 228 may subsequently be moved to a generally orthogonal position relative to the frame member 111 in order to reverse the clamping effect.

The first means 130 includes a seat or flexible sheet of material 132 having a forward end and a rearward end. The forward end is supported by flexible straps 136, which are formed into loops and disposed about the forward frame member 111. The rearward end is formed into a loop 134 and disposed about the rearward frame member 112. The length of material 132 suspended between the frame members 111 and 112 may be adjusted by providing buckles on the straps 136 in a manner known in the art.

The first means 130 preferably includes a pair of foot supports or flexible straps of material 142, each of which has a rearward end 144 and a forward end 146. Each forward end 146 is connected to a respective strap 136 proximate its juncture with the seat 132. Each rearward end 144 is connected to a support 124, which is slideably mounted on a respective frame member 113 or 114 and secured in place by a set screw. The length of either foot support 142 may be adjusted by providing buckles on the straps 142 in a manner known in the art.

The second means 150 includes a pair of "forward-facing" rowing assemblies, each of which includes (a) a base 151 movably mounted on a respective frame member 113 or 114; (b) a handle 155 having a first end sized and configured for grasping, an intermediate portion rotatably mounted on the base 151, and a second, opposite end; (c) an oar 157 having a first, paddle end, an intermediate portion rotatably mounted on the base 151, and a second opposite end; and (d) a link 159 rotatably interconnected between the second end of the oar 157 and the second end of the handle 155. The port link 159 constrains the port handle 155 and the port oar 157 to rotate in opposite directions relative to one another and their respective base 151; and the starboard link 159 constrains the starboard handle 155 and the starboard oar 157 to rotate in opposite directions relative to one another and their respective base 151. A stop 158 on each base 151 limits rearward rotation of a respective oar 157.

Each base 151 is slideably and rotatably mounted on a respective frame member 113 or 114 by means of bearings 153. The bearings facilitate rotation of each base 151 relative to its respective frame member 113 or 114 during rowing motions. Each base 151 is disposed between a pair of stops 123 which are slideable along a respective frame member 113 or 114 and selectively secured in desired positions by means of set screws.

An alternative rowing assembly is designated as 250 in FIGS. 4*a* and 4*b*. Like the assembly 150 described above, the rowing assembly 250 includes a base 251 which is rotatably mounted on the frame member 113 between a pair of stops 123'. A handle 255 has a first end sized and configured for grasping; a second, opposite end; and an intermediate portion mounted on the base 251 and rotatable relative thereto about an axis A (extending perpendicular to the drawing sheet). An oar 257 has a first, paddle end; a second, opposite end; and an intermediate portion mounted on the base 251 and rotatable relative thereto about an axis B (extending perpendicular to the drawing sheet). A stop 258 on each base 251 limits rearward rotation of the oar 257. The axes A and B are disposed on opposite sides of the longitudinal axis L of the frame member 113 and spaced approximately equal distances therefrom.

A link 259 is rotatably interconnected between the second end of the oar 257 and the second end of the handle 255. The link 259 and the handle 255 cooperate to define a rotational axis C, and the link 259 and the oar 257 cooperate to define a rotational axis D. The distance between the axes C and D is almost double the distance between the axes B and D, and the distance between the axes A and C is almost one and one-half time the distance between the axes B and D.

The foregoing description and accompanying figures are limited to specific embodiments and a particular application of the present invention. Recognizing that those skilled in the art may recognize additional embodiments and/or improvements which incorporate aspects of the present invention, the scope of the present invention is to be limited only to the extent of the following claims.

What is claimed is:

1. An apparatus sized and configured for mounting on a conventional canoe, comprising:

a frame adapted to be supported by opposite sides of the canoe, wherein each side of the frame comprises a cylindrical member;

a first means, suspended from the frame, for supporting a person in a seated position, facing forward, relative to the frame; and a second means, mounted on the frame, for enabling the person to row the canoe forward while facing forward, wherein the second means includes a discrete rowing assembly mounted on each side of the frame, and each rowing assembly includes a base rotatably mounted on a respective cylindrical member; a handle rotatably mounted to the base; an oar rotatably mounted to the base; and a link rotatably interconnected between the handle and the oar and constraining the handle and the oar to rotate in opposite directions relative to one another and the base.

2. The apparatus of claim 1, wherein the first means includes a flexible sheet of material interconnected between a forward frame member and a rearward frame member.

3. The apparatus of claim 2, wherein the first means further includes flexible straps of material interconnected between the flexible sheet of material and opposite sides of the frame.

4. The apparatus of claim 1, further comprising stops secured to each side of the frame adjacent each end of each rowing assembly, wherein each of the stops is selectively moveable along its respective side.

5. The apparatus of claim 1, wherein the frame includes four cylindrical members arranged in a generally rectangular configuration which is wider than the canoe.

6. The apparatus of claim 5, wherein the first means includes a flexible sheet of material interconnected between a first opposite pair of the cylindrical members, and the second means includes a discrete rowing assembly rotatably mounted to each of a second opposite pair of the cylindrical members.

7. An apparatus sized and configured for mounting on a conventional canoe, comprising:

a frame which includes a forward member, a rearward member, a port member and a starboard member, wherein the forward member is adapted to be supported by opposite sides of the canoe, and the rearward member is adapted to be supported by opposite sides of the canoe, and the port member and the starboard member are interconnected between discrete portions of the forward member and the rearward member, and the forward member and the rearward member lie in a common plane and define a distance therebetween; and a flexible seat having a first end connected to the forward member, an opposite, second end connected to the rearward member, and a length of seat material suspended therebetween, wherein the length is greater than the distance, and the seat hangs downward beneath the plane, wherein the length of seat material suspended between the forward member and the rearward member is adjustable and affects how far downward the seat hangs beneath the plane.

8. The apparatus of claim 7, further comprising a port rowing assembly rotatably mounted on the port member, and a starboard rowing assembly rotatably mounted on the starboard member, wherein each rowing assembly rotates about an axis extending generally perpendicular to the forward member.

9. The apparatus of claim 8, wherein the port rowing assembly is selectively adjustable along the port member, in a direction parallel to its rotational axis, and the starboard rowing assembly is selectively adjustable along the starboard member, in a direction parallel to its rotational axis.

10. The apparatus of claim 8, wherein each rowing assembly includes a base; a handle rotatably mounted to the base; an oar rotatably mounted to the base; and a link rotatably interconnected between the handle and the oar and constraining the handle and the oar on each rowing assembly to rotate in opposite directions relative to one another and the base.

11. An apparatus sized and configured for mounting on a conventional canoe, comprising:

a frame which includes a forward member, a rearward member, a port member and a starboard member, wherein the forward member is adapted to be supported by opposite sides of the canoe, and the rearward member is adapted to be supported by opposite sides of the canoe, and the port member and the starboard member are interconnected between discrete portions of the forward member and the rearward member, and the forward member and the rearward member lie in a common plane and define a distance therebetween;

a flexible seat having a first end connected to the forward member, an opposite, second end connected to the rearward member, and a length of seat material suspended therebetween, wherein the length is greater than the distance, and the seat hangs downward beneath the plane; and a left foot support having opposite ends connected to the frame and an intermediate portion hanging downward beneath the plane; and a right foot support having opposite ends connected to the frame and an intermediate portion hanging downward beneath the plane.

12. The apparatus of claim 11, wherein the left foot support has an adjustable length suspended between the forward member and the port member, and the right foot support has an adjustable length suspended between the forward member and the starboard member.

13. An apparatus sized and configured for mounting on a conventional canoe, comprising:

a frame which includes a forward member, a rearward member, a port member and a starboard member, wherein the forward member is adapted to be supported by opposite sides of the canoe, and the rearward member is adapted to be supported by opposite sides of the canoe, and the port member and the starboard member are interconnected between discrete portions of the forward member and the rearward member;

a flexible seat suspended between the forward member and the rearward member;

a left foot support having opposite ends connected to the frame, and a middle portion hanging downward from the frame;

a right foot support having opposite ends connected to the frame, and a middle portion hanging downward from the frame.

14. The apparatus of claim 13, wherein one of the ends of the left foot support is connected to the forward member, and an opposite one of the ends of the left foot support is connected to the port member, and one of the ends of the right foot support is connected to the forward member, and an opposite one of the ends of the right foot support is connected to the starboard member.

15. The apparatus of claim 13, wherein the middle portion of each said foot support has an adjustable length.

16. A canoe attachment, comprising:

a frame which includes a forward member, a rearward member, a port side member and a starboard side member, wherein the port side member and the starboard side member are cylindrical members interconnected between discrete portions of the forward member and the rearward member; and a port side rowing assembly and a starboard side rowing assembly, wherein each said rowing assembly includes a base rotatably mounted on a respective one of the cylindrical members, and each said rowing assembly further includes a handle and an oar rotatably mounted on a respective base and constrained to rotate in opposite directions relative to one another.

17. The attachment of claim 16, further comprising stops secured to respective cylindrical members adjacent each end of each said rowing assembly, wherein the stops are selectively movable along respective cylindrical members.

18. A canoe attachment, comprising:

a frame which includes a port side member and a starboard side member; and a port side rowing assembly and a starboard side rowing assembly, wherein each said rowing assembly includes a base mounted on a respective side member; a handle rotatably mounted on the base and rotatable about a first axis relative to the base; an oar rotatably mounted on the base and rotatable about a second axis relative to the base; and a link rotatably interconnected between the handle and the oar; wherein the link is rotatable about a third axis relative to the handle, and the link is rotatable about a fourth axis relative to the oar, and a first distance is defined between the second axis and the fourth axis, and a second distance is defined between the third axis and the fourth axis, and a third distance is defined between the first axis and the third axis, and the third distance is one and one-half times as great as the first distance.

19. The attachment of claim 18, wherein the second distance is twice as great as the first distance.

* * * * *